US006189880B1

(12) United States Patent
Besold

(10) Patent No.: US 6,189,880 B1
(45) Date of Patent: Feb. 20, 2001

(54) DEVICE FOR COLLATING SHEETS OF PAPER

(75) Inventor: Ralf Besold, Munich (DE)

(73) Assignee: Rena Infomationstechnik GmbH & Co. KG, Oberhaching (DE)

( * ) Notice: Under 35 U.S.C. 154(b), the term of this patent shall be extended for 0 days.

(21) Appl. No.: 09/073,716

(22) Filed: May 6, 1998

(30) Foreign Application Priority Data

May 6, 1997 (DE) ..... 197 18 998

(51) Int. Cl.[7] ..... B65H 39/042

(52) U.S. Cl. ..... 270/58.25; 271/9.01; 271/9.11; 271/9.13; 273/149 R

(58) Field of Search ..... 273/149 R; 270/58.25, 270/58.23, 58.33, 58.34; 271/9.01, 9.11, 9.12, 9.13

(56) References Cited

U.S. PATENT DOCUMENTS

| | | | | |
|---|---|---|---|---|
| 373,953 | * | 11/1887 | Tingley et al. | 273/149 R |
| 1,955,926 | * | 4/1934 | Matthaey | 273/149 R |
| 2,159,958 | * | 5/1939 | Sachs | 273/149 R |
| 2,599,829 | * | 6/1952 | Hernblad | 270/58.25 |
| 2,706,117 | * | 4/1955 | Notz | 273/149 R |
| 2,821,384 | * | 1/1958 | Mendes | 270/58.25 |
| 3,510,119 | | 5/1970 | Linden . | |
| 4,310,160 | * | 1/1982 | Willette et al. | 273/149 R |
| 5,711,518 | * | 1/1998 | Portaro et al. | 271/188 X |
| 5,718,427 | * | 2/1998 | Cranford et al. | 273/149 R |
| 5,954,473 | * | 9/1999 | Folsom | 271/223 X |

FOREIGN PATENT DOCUMENTS

| | | |
|---|---|---|
| 664 749 A5 | 3/1988 | (CH) . |
| 55-151457 | 11/1980 | (JP) . |

* cited by examiner

*Primary Examiner*—Christopher P. Ellis
*Assistant Examiner*—Patrick Mackey
(74) *Attorney, Agent, or Firm*—Shaffer & Culbertson, LLP

(57) ABSTRACT

A device for collating sheets of paper into a stack includes an elongated chute and at least one feeder. The chute has a transverse shape approximating the size of the sheets of paper to be fed into the chute. Each feeder feeds a sheet of paper into the chute so that the plane of the paper extends generally transverse to a vertical axis of the chute. The sheets of paper thus fed into the chute may then float downwardly on a cushion of air coming to rest in a bottom area of the chute.

13 Claims, 1 Drawing Sheet

DEVICE FOR COLLATING SHEETS OF PAPER

BACKGROUND OF THE INVENTION

The invention pertains to a device for collating sheets of paper for subsequent transport together to a collection station, with feeders for separating the sheets of paper. In the general state of the art it is already known how to separate the sheets of paper arriving for collation, in particular in an envelope-stuffing or collating system, for example, by means of a conveyor belt, for transport to a collection station. Further processing, such as envelope stuffing and distribution in a collection bin occurs from this collection station.

SUMMARY OF THE INVENTION

The present invention addresses the problem of improving a collating device to increase the effectiveness and efficiency of the collation operation.

This problem is solved according to this invention, in that the feeders provided for simultaneous feeding of the sheets of paper are connected to a chute which is located above the collection station. The advantage of this arrangement is that the separated sheets of paper are fed into a chute which is free of transport restrictions of any kind. Therefore, mechanical transport features are not needed, so that the expense for the manufacture of such equipment will be reduced significantly.

The separated sheets of paper fed into the chute float downwardly on a cushion of air and thus an orderly collating of the sheets of paper is possible in an exceptionally simple and effective manner. The cross section of the chute in this case should preferably be dimensioned so that the side walls forming the shaft have a spacing which is only slightly larger than the length of the appropriate side of the sheet of paper. In this regard, it should be mentioned that the paper for collation need not be individual sheets of paper, of course. Rather, already folded or otherwise joined paper may be used. The term paper as used within the framework of this disclosure is not restricted exclusively to the material "paper." Rather, this term is intended also to include sheet-like, also folded or otherwise joined, sheets or leaves of any particular material, such as plastic.

The feeding of the sheets of paper takes place preferably simultaneously, so that due to the presence of the chute, a uniform sinking of the separated sheets of paper is possible.

In a further refinement of the invention, the chute can have a rectangular shape, whereby the feeders are located on at least on one side of the chute. Alternatively, it is possible to place the feeders at opposite sides of the chute and with a height offset. For a smooth output of the sheets of paper, the feeders can be positioned at an angle to a vertical axis of the chute, whereby it is expedient for the angle of incline of the feeders to be in a range of 60° to 80°, with respect to the vertical axis.

According to another feature of the invention, the feeders on the front side leading to the chute are each equipped with a retention device and with separating rollers. In order to be able to transport relatively soft sheets of paper, in a further refinement of the invention, an additional stabilizing roller can be provided in the feeder which gives the sheets of paper a slight V-shape. This will stabilize the sheets of paper and improve the aerodynamics of the sheets of paper moving in the chute.

Openings for the escape of air can be provided, preferably in the base of the chute, so that the air located underneath the sheets of paper floating downward can escape below and the sinking movement of the sheets of paper will not be disrupted by eddy currents or streams. Thus a clean collating or placement will be assured.

In a preferred embodiment of the invention, at least one, and preferably two, of the side walls forming the chute are designed so that the distance between the mutually opposite side walls can be adjusted. In this regard, the given side walls are designed so that they are displaceable. Preset positions corresponding to fixed standard sizes of sheets of paper can be defined by lock-in positions. The given side walls can be locked into these lock-in positions, but it should also be possible to lock the walls in any particular intermediate position. Thus, sheets of paper of different size can be optimally collated. By setting of the distance(s) of the side walls, that is, defining the cross section of the chute, the air cushion forming beneath the sheets of paper, and thus the rate of sinking and the sinking behavior of the sheets of paper, can be affected and adjusted in an optimum manner.

The adjusting of the position of the side walls can take place, of course, through the use of a suitable adjusting drive.

The invention will be explained in greater detail below based on the embodiments presented in the drawing.

These and other objects, advantages, and features of the invention will be apparent from the following description of the preferred embodiments, considered along with the accompanying drawings.

DESCRIPTION OF THE PREFERRED EMBODIMENTS

Figure 1:
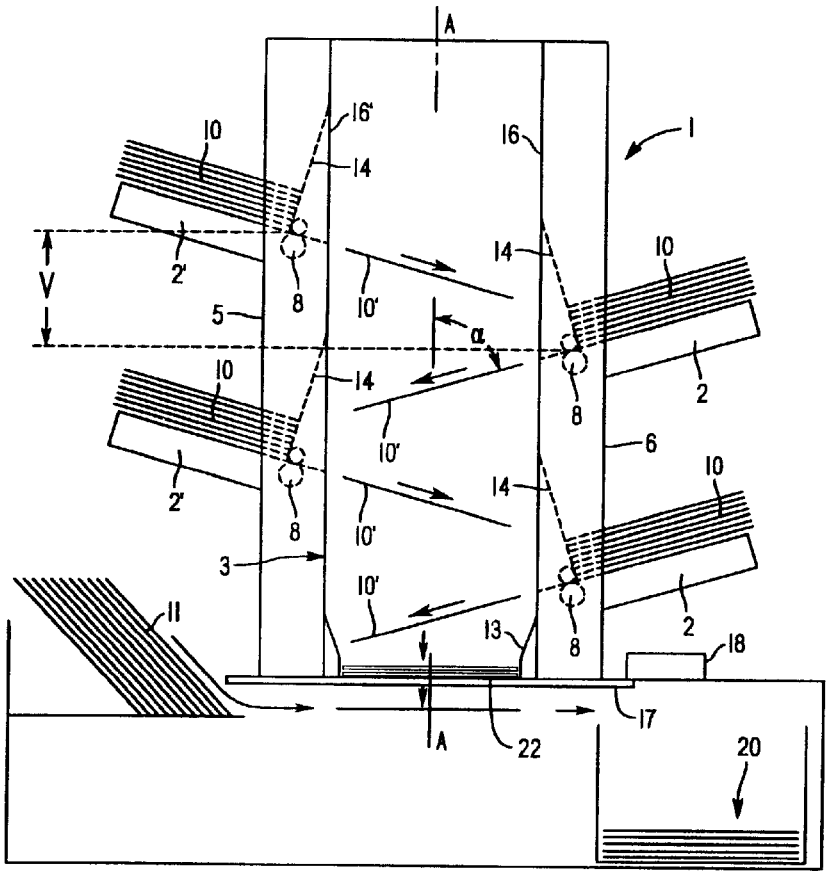
FIG. 1 is a schematic side view of the device embodying the principles of the invention for collating sheets of paper.

FIG. 1 presents a device 1 for collating of sheets of paper 10. The device 1 is combined with an additional device for the feeding of envelopes 11 and a collection station 20, so that the device presented in FIG. 1 pertains to an envelope-stuffing machine.

The device 1 features a chute 3, which has preferably a rectangular shape, whereby at the base of the chute, the sheets of paper 10 are collated into a stack of paper 22. At the bottom there are preferably features which ensure a neat forming of the stack, for example, in the form of guide walls 13. Furthermore, although not shown in the figures, features can be provided for keeping the stack of paper 22 until it is fully formed and for release of the finished stack of paper 22 for subsequent processing.

One or more of the side walls, side walls 16 and 16', for example, forming the chute can be of adjustable design with regard to their position or spacing. Thus it is possible to adapt the spacing of the side walls to the particular edge lengths of the sheets of paper being collated. As an adjustment, the side walls can be moved along one or more rails 17. The rails and the side walls moving thereon can define lock-in positions which correspond to the standard sizes of the sheets of paper to be collated. Of course, an adjustment drive 18 can also be provided for automatic adjustment of the side walls. Thus the adjustment of the spacing of the side walls can be performed, for example, by merely pressing a button on an appropriate operator console.

By adjustment of the cross section of the chute 3, the sinking behavior of the sheets of paper being collated, in particular the rate of sinking, can be adjusted in an optimum manner. Thus an optimum collating result will be assured, namely, of the formation of a neat and orderly stack of paper 22 at the bottom of the chute 3.

In the embodiment presented in FIG. 1, the feeders 2 and 2' are used for separating the sheets of paper 10 and these feeders are located at opposite sides 5 and 6 of the chute 3. In the present case, on each of the sides 5 and 6 there are two feeders 2 and 2', which are offset in height with respect to each other, that is, by an amount V between the feeder 2 on side 6 and the feeder 2' on side 5, for instance.

These feeders 2 and 2' are inclined with a vertical axis A—A of the chute 3, wherein the angle of inclination $\alpha$ of the feeders 2, 2' is about 60° to 80° with respect to vertical axis A—A.

From FIG. 1 it is evident that the feeders 2, 2' are each provided with a retainer 14 and with separating rollers 8 on the front side leading to the chute 3.

Starting materials, that is, sheets of paper 10, which are present on the particular feeders 2, 2', are usually already prefolded, whereby these sheets of paper 10 have a high inherent stability due to the folding.

The sheets of paper 10' singled out by the feeders 2, 2' drop into the chute 3 which is free of any kind of transport restrictions. As is evident in the representation according to FIG. 1, there are four separated sheets of paper 10' in the chute that are fed in simultaneously via the two pairs of height-offset feeders 2 and 2'.

Due to this configuration of the shaft, a uniform and simultaneous sinking of the individual sheets of paper 10' is possible, and the sheets collect at the bottom of the chute 3 to form the stack of paper 22.

Figure 2:
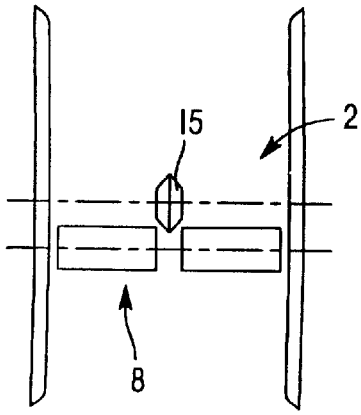
FIG. 2 is front view of the feeding device with stabilizing rollers.

Each stack of paper 22 may then be pushed in a known (and not illustrated) manner into an envelope 11 supplied from the underside of the device 1. Thereafter, the envelopes may be closed and sent to the collection station 20. In order also to be able to transport and collate even relatively soft sheets of paper, according to FIG. 2 it is possible to install an additional stabilizing roller 15 in the particular feeders 2 and 2'. Due to this stabilizing roller 15, a slight V-shape is imparted to the given sheets of papers 10', so that a stabilization of the paper will result. Thus the aerodynamics of the paper 10' moving downwardly in the chute 3 are improved. The attachment of the feeders can occur both on the right and left side of the chute 3, or on both sides. Thus an increase in the system capacities is obtained for the individual feeders. In addition, the sheets of paper 10' supplied to the chute 3 are stabilized by the simultaneous and uniform sinking onto the stack 22. The device 1 according to this invention for collating sheets of paper makes it possible to increase the efficiency of the overall device in a simple manner.

The above-described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A device for collating sheets of paper, the device including:

(a) a substantially vertical and elongated chute having a first side wall and an opposite side wall, the first side wall and opposite side wall extending substantially parallel to each other and being spaced apart a distance greater than a side dimension of the paper to be collated;

(b) a collection station positioned at a bottom of the chute;

(c) a first feeder positioned on the first side wall of the chute for feeding a first sheet of paper into the chute so that the first sheet of paper extends generally transverse to a vertical axis of the chute, the first feeder positioned on the first side wall outside of the area defined by the chute between the first side wall and opposite side wall; and (d) at least one additional feeder positioned on the first side wall of the chute, each respective additional feeder being positioned at a different spaced apart position along the vertical axis of the chute with respect to the first feeder and outside of the area defined by the chute for feeding a respective additional sheet of paper into the chute so that the respective additional sheet of paper extends generally transverse to the vertical axis of the chute.

2. The device of claim 1 wherein each additional feeder feeds the respective additional sheet of paper into the chute simultaneously as the first feeder feeds the first sheet of paper into the chute.

3. The device of claim 1 further including:

(a) at least one opposite side wall feeder positioned on the opposite side wall of the chute, each respective opposite side wall feeder being positioned in a different spaced apart position along the vertical axis of the chute with respect to the first feeder and with respect to each additional feeder, and each opposite side wall feeder for feeding a respective further sheet of paper into the chute so that the respective further sheet of paper extends generally transverse to the vertical axis of the chute.

4. The device of claim 2 wherein each additional feeder feeds the respective additional sheet of paper into the chute simultaneously as the first feeder feeds the first sheet of paper into the chute and as each opposite side wall feeder feeds the respective further sheet of paper into the chute.

5. The device of claim 1 wherein the transverse shape of the chute is rectangular.

6. The device of claim 1 wherein the first feeder and each additional feeder is positioned at an angle of inclination with respect to the vertical axis of the chute.

7. The device of claim 6 wherein the angle of inclination of the first feeder and each additional feeder is 60° to 80°.

8. The device of claim 1 wherein the first feeder or at least one additional feeder includes a roller arrangement for imparting a V-shape to the respective sheet of paper as the sheet is fed in to the chute by the respective feeder.

9. The device of claim 8 wherein the roller arrangement includes:

(a) two separating rollers mounted to rotate about a separating roller axis extending generally parallel to the first side wall and transverse to the vertical axis of the chute, the two separating rollers being spaced apart along the separating roller axis in position to contact a lower surface of the respective sheet of paper; and (b) a stabilizing roller mounted to rotate about a stabilizing roller axis extending parallel to the separating roller axis, the stabilizing roller being located between the spaced apart separating rollers in position to contact an upper surface of the respective sheet of paper.

10. The device of claim 1 wherein the cross section of the chute is adjustable.

11. The device of claim 1 further including:

(a) an adjusting mechanism facilitating adjustment in the separation between the first side wall of the chute and the opposite side wall of the chute.

12. A device for collating sheets of paper, the device including:

(a) a substantially vertical and elongated chute having a first side wall and an opposite side wall, the first side wall and opposite side wall extending substantially parallel to each other and being spaced apart a distance greater than a side dimension of the paper to be collated;

(b) a collection station positioned at a bottom of the chute;

(c) a first feeder positioned on the first side wall of the chute for feeding a first sheet of paper into the chute so that the first sheet of paper extends generally transverse to a vertical axis of the chute; and (d) a roller arrangement associated with the first feeder for imparting a V-shape to the first sheet of paper as it is fed in to the chute.

13. The device of claim 12 wherein the roller arrangement includes:

(a) two separating rollers mounted to rotate about a separating roller axis extending generally parallel to the first side wall and transverse to the vertical axis of the chute, the two separating rollers being spaced apart along the separating roller axis and positioned to contact a lower surface of the first sheet of paper; and (b) a stabilizing roller mounted to rotate about a stabilizing roller axis extending parallel to the separating roller axis, the stabilizing roller being located between the spaced apart separating rollers in position to contact an upper surface of the first sheet of paper.

* * * * *